United States Patent [19]

Smith

[11] 3,943,887

[45] Mar. 16, 1976

[54] HYBRID CROSSMIXER

[75] Inventor: Richard E. Smith, Webster, N.Y.

[73] Assignee: Xerox Corporation, Stamford, Conn.

[22] Filed: Feb. 27, 1975

[21] Appl. No.: 553,756

[52] U.S. Cl. ..... 118/637; 118/612; 259/4 R; 427/14; 427/18

[51] Int. Cl.[2] ..... G03G 15/08

[58] Field of Search..... 118/612, 637; 355/3 DD; 259/4 R, 4 A, 4 AB; 427/14, 18

[56] References Cited

UNITED STATES PATENTS

| | | | |
|---|---|---|---|
| 2,910,964 | 11/1959 | Stavrakis et al. | 118/637 |
| 3,648,657 | 3/1972 | Rueckwald | 118/637 |
| 3,697,050 | 10/1972 | Stanley | 118/637 |
| 3,881,446 | 5/1975 | Kurita et al. | 118/637 |
| 3,882,823 | 5/1975 | Tanaka et al. | 118/637 |

*Primary Examiner*—Mervin Stein
*Assistant Examiner*—Douglas Salser

[57] ABSTRACT

To provide simultaneous and efficient mixing and blending of the toner and carrier components of a multicomponent developer, there is a hybrid crossmixer comprising an auger-type active section and a pair of baffle-type passive sections. The crossmixer is used, for example, in a magnetic brush development system on the downstream side of the development zone. In that event, the partially denuded developer exiting from the development zone is split, with approximately half being routed to the active section and the other half being more or less equally divided between the two passive sections. Furthermore, the additional toner needed from time-to-time to maintain the toner concentration of the developer at a suitably high level enters the system via the active section of the crossmixer to ensure that it is rapidly blended in with the balance of the developer.

12 Claims, 4 Drawing Figures

HYBRID CROSSMIXER

BACKGROUND OF THE INVENTION

This invention relates to development systems for electrostatographic processors and, more particularly, to hybrid crossmixers for such systems.

In a conventional electrostatographic printing process of the type described in Carlson's U.S. Pat. No. 2,297,691 on "Electrophotography," a uniformly charged imaging surface is selectively discharged in an image configuration to provide a latent electrostatic image which is then developed through the application of a finely divided coloring material, called "toner." That process has enjoyed outstanding commercial success, especially in xerographic copiers and duplicators.

Xerography, of course, involves the use of a photoconductive imaging surface which is coated or otherwise deposited on an electrically conductive backing, such as a drum or an endless belt in a plain paper copier. There are, however, other types of electrostatographic processors. For example, there are some wherein the imaging surface is a uniformly charged electrically insulative member which is selectively discharged non-photographically — e.g., by appropriately controlled stylii — to provide a latent electrostatic image of the same general type as is photographically generated in a xerographic processor. Moreover, it should be understood that xerographic and similar electrostatographic processes are not limited to use in stand alone copiers and duplicators. For example, those processes have also been found to have utility in the facsimile art.

The vehicle normally used in electrostatographic processors to deliver the toner needed for development purposes is a multi-component developer comprising a mixture of toner particles and larger, so-called "carrier" particles. The materials for the toner and carrier (or, sometimes, carrier coating) components of the mixture are selected so that they are removed from each other in the triboelectric series, whereby electrical charges of opposite polarities tend to be imparted to the toner and carrier particles when they rub together. Furthermore, in making those selections, consideration is given to the triboelectric ranking of the materials to the end that the polarity of the charge nominally imparted to the toner particles opposes the polarity of the latent images which are to be developed. Consequently, in operation, there are competing electrostatic forces acting on the toner particles. Specifically, there are forces which at least initially tend to attract them to the carrier particles. Additionally, the toner particles are subject to being electrostatically stripped from the carrier particles whenever they are brought into the immediate proximity of or actual contact with an image bearing imaging surface.

Existing development systems commonly include a toner dispenser for adding additional toner to the developer supply from time-to-time so that its toner concentration remains at a suitably high level. Also, there typically is a crossmixer for mixing and blending the toner and carrier components of the developer so that the toner is more or less uniformly distributed throughout the developer and the triboelectric charging of the toner and carrier particles is promoted.

Surprisingly, available crossmixers still show a weakness when measured by their ability to carry out the mixing and blending functions simultaneously. As a general rule, passive crossmixers are effective mixing devices, but only marginally acceptable as blending devices. Active crossmixers on the other hand, normally are effective blending devices, but only marginally acceptable as mixing devices. As used herein, "mixing" refers to the distribution of the toner throughout the developer, and "blending" refers to the agitation of the developer which leads to the triboelectric charging of the toner and carrier particles.

SUMMARY OF THE INVENTION

Accordingly, an object of the present invention is to provide a crossmixer which is efficient both as a mixing device and as a blending device. More particularly, an object is to provide a compact and relatively simple crossmixer for effectively accomplishing the mixing and blending functions simultaneously.

To carry out these and other objects of the invention, there is a hybrid crossmixer comprising active and passive sections which are operated in parallel to simultaneously mix and blend the toner and carrier components of the developer circulating through the development system of an electrostatographic processor. A relatively simple and compact cross-mixer of the foregoing type comprises an auger-type active section and a pair of baffle-type passive sections. To take advantage of that crossmixer, the developer flow is split so that roughly one half of the developer passes through the active section while the other half is more or less equally divided between the two passive sections. The additional toner needed from time-to-time to maintain the toner concentration of the developer at a suitably high level is preferably routed through the active section to take advantage of its superior blending capabilities.

BRIEF DESCRIPTION OF THE DRAWINGS

Still further objects and advantages of this invention will become apparent when the following detailed description is read in conjunction with the attached drawings, in which.

DETAILED DESCRIPTION OF THE ILLUSTRATED EMBODIMENTS

While the invention is described in some detail hereinafter with specific reference to a certain embodiment, it is to be understood that there is no intent to limit it to that embodiment. On the contrary, the aim is to cover all modifications, alternatives and equivalents falling within the spirit and scope of the invention as defined by the appended claims.

Figure 1:
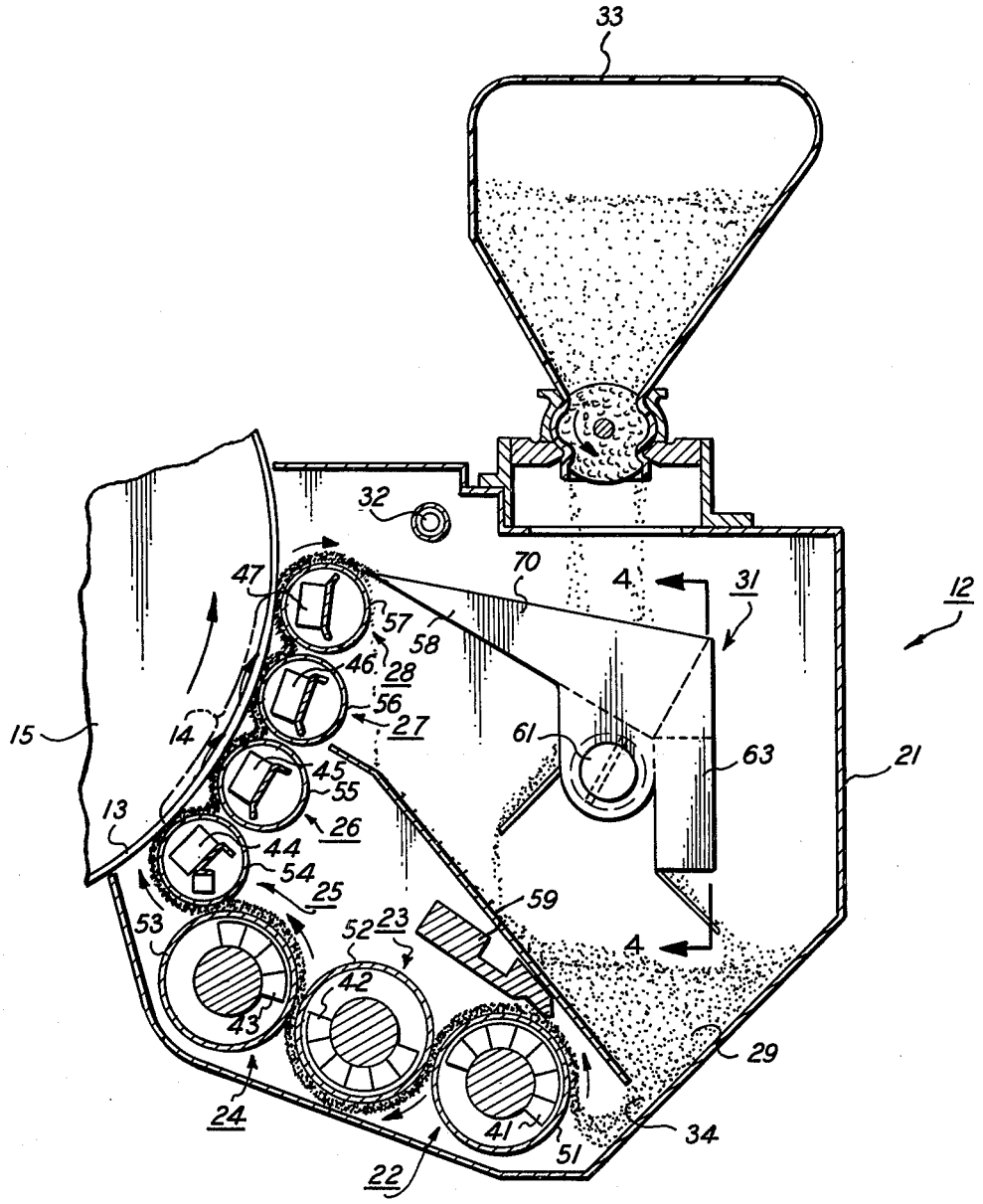
FIG. 1 is a fragmentary, sectional view of an electrostatographic processor having a development system including a hybrid crossmixer constructed in accordance with the present invention.

Turning now to the drawings, and at this point especially to FIG. 1, there is an electrostatographic processor 11 (shown only in relevant part) having a magnetic brush development system 12 for developing latent electrostatic images carried by an electrically insulative imaging surface 13 on the fly — viz., as the imaging surface 13 moves through a development zone 14. In this instance, the processor 11 is a more or less conventional xerographic copier or the like having a rotatably driven drum 15 coated with a photoconductive imaging surface.

As shown, the development system 12 comprises a housing 21 having a series of transport rolls 22–24 and a series of applicator rolls 25–28 for circulating developer along a path which runs from a sump 29 in the lower reaches of the housing 21, through the development zone 14, and then back to the sump 29 via a crossmixer 31. In keeping with generally accepted practices, the developer comprises a mixture of triboelectrically charged toner particles and ferromagnetic carrier particles. Advantageously, there is a port 32 for returning reclaimed toner to the development system 12 from, say, a photoreceptor cleaning system (not shown). Additionally, there is a toner dispenser 33 for adding fresh or virgin toner to the developer from time-to-time so that its toner concentration remains at a suitably high level.

More particularly, in operation, developer is gravity fed through an elongated discharge orifice or slot 34 near the bottom of the sump 29 and is then magnetically constrained to follow a generally S-shaped path through the transport rolls 22–24 and to thereafter advance upwardly between the photoconductor 13 and successive ones of the applicator rolls 25–28. To that end, the transport rolls 22–24 and the applicator rolls 25–28 comprise individual permanent magnet assemblies 41–47 which are stationarily supported with separate non-magnetic sleeves 51–57, respectively. The magnetic assemblies 41–47 and the sleeves 51–57 typically extend across substantially the full width of the development zone 14. Moreover, the sleeves 51–57 are rotatably driven (by means not shown) in the directions indicated by the arrows so that the developer magnetically entrained thereon under the influence of the magnetic fields provided by the magnetic assemblies 41–47 is transported, as above described, from the sump 29 to the last or uppermost applicator roll 28. After passing between that roll and the photoconductor 13, the developer is discharged onto a downwardly sloping ramp 58 which guides it into the crossmixer 31 as more fully described hereinbelow.

As is usually the case in development systems of this type, the sleeves 54–57 of the applicator rolls 25–28 are spaced a predetermined short distance from the photoconductor 13, and the magnetic fields emanating from the magnetic assemblies 44–47 are shaped to cause the developer on the sleeves 54–57 to form bristle-like stacks or steamers which bridge that space. Hence, the developer brushes against the photoconductor 13 while passing between the photoconductor and each of the sleeves 54–57, thereby developing any latent images which happen to be present. Desirably, of course, there is a more or less uniform flow of developer across the full width of the development zone 14. Consequently, in the illustrated embodiment, there is a trimmer bar 59 for leveling the profile of the developer entrained on the sleeve 51 of the first transport roll 22.

Figure 2:
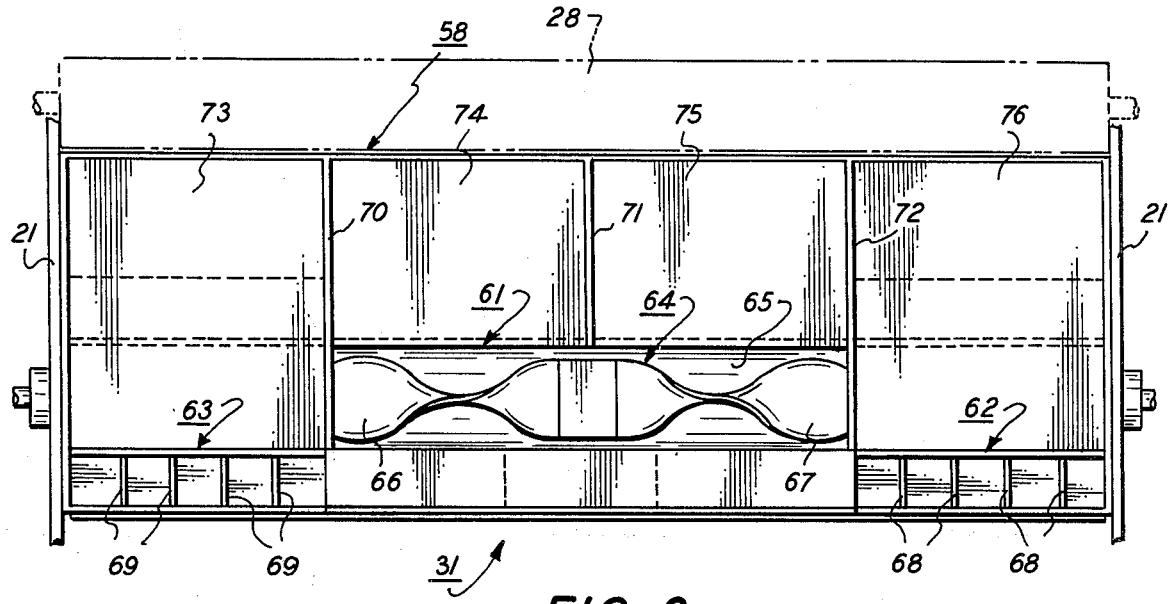
FIG. 2 is a plan view of the crossmixer.
Figure 3:
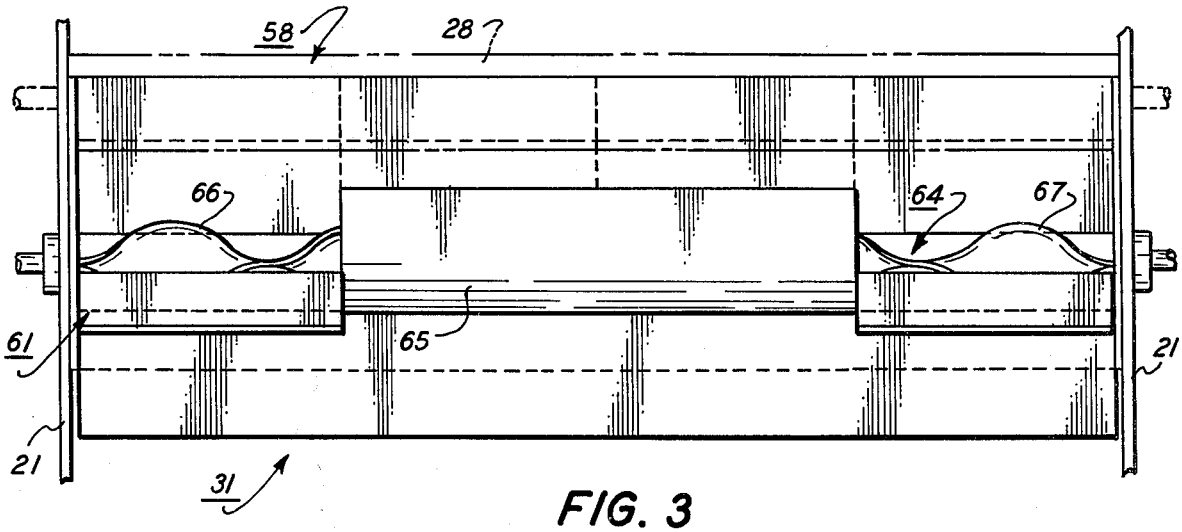
FIG. 3 is an elevational view of the crossmixer as seen from the imaging surface side of the development system.
Figure 4:
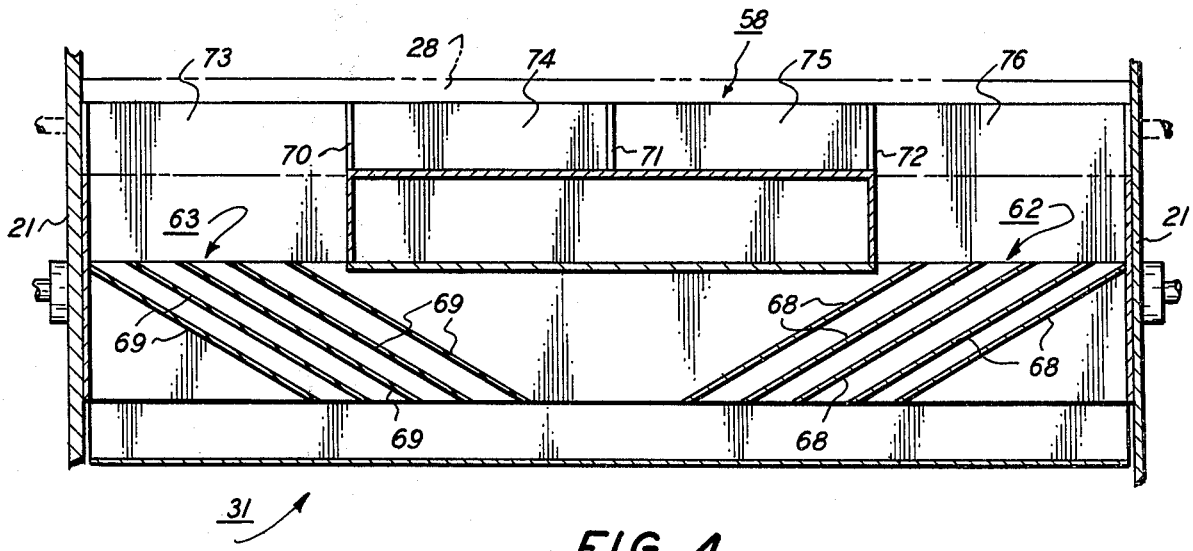
FIG. 4 is a sectional view of the crossmixer taken along the line 4—4 in FIG. 2.

Referring additionally to FIGS. 2–4, in accordance with this invention, the crossmixer 31 is a hybrid unit having an active section 61 and a pair of passive sections 62 and 63. As illustrated, the active section 61 includes a rotatably driven, compound auger 64 which extends across substantially the full width of the housing 21 within a generally J-shaped trough 65. The trough 65 partially surrounds the auger 64 which, in turn, has a right-hand helix 66 along approximately one half of its length and a left-hand helix 67 along the other half. The passive sections 62 and 63, on the other hand, are mounted on opposite sides of the housing 21 and contain separate sets of spaced apart internal baffles or vanes 68 and 69, respectively, which are inwardly and downwardly inclined. Suitably, the active section 61 and the passive sections 62 and 63 are supported with the housing 21 by a common frame.

To carry out the invention, the active section 61 and the passive sections 62 and 63 are provided with parallel flows of developer from the last or uppermost applicator roll 28. The flow is divided so that roughly one half is routed to the active section 61 and the other half is more or less equally divided between the two passive sections. To accomplish that, the ramp 58 has three upwardly extending partitions 70–72 equidistantly spaced across its width so that it is effectively divided into four equally wide channels 73076. The outer two channels 73 and 76 guide developer into respective ones of the passive sections 62 and 63, and the inner two channels 74 and 75 guide developer into the trough 65 of the active section 61. The developer entering the passive sections 62 and 63 is deflected inwardly toward the center of the housing 21 by the baffles 68 and 69, respectively, while enroute to the sump 29. Contraiwise, the developer entering the trough 65 is urged outwardly towards the opposite sides of the housing 21 by the auger 64 while enroute to the sump 29. Indeed, there preferably is a baffle plate 76 to prevent the developer from flowing out of the central portion of the trough 65. Thus, there is a very effective mixing pattern.

Some blending of the toner and carrier components of the developer takes place in the passive sections 62 and 63 of the crossmixer 31, but the active section 61 is far more effective from the standpoint. Accordingly, in keeping with one of the more detailed aspects of this invention, the return port 32 for the reclaimed toner and the toner dispenser 33 are vertically aligned with the flow path (i.e., one or both of the inner two channels 74 and 75) leading to the trough 65, thereby ensuring that substantially all of the additional toner is routed through the active section 61 of the crossmixer 31 before entering the sump 29. Ideally, of course, the additional toner is divided by the partition 71 so that half enters the right-hand side of the trough 65 and the other half enters the left-hand side of the trough 65.

CONCLUSION

In view of the foregoing, it will now be understood that a simple and compact hybrid crossmixer has been provided, and that the crossmixer has the distinct advantage of being able to simultaneously provide effective mixing and blending of multi-component developers. While the crossmixer has been described in connection with a magnetic brush development system for illustrative purposes, it will be apparent that the principles of the invention may be applied to other types of development systems.

What is claimed is:

1. In a development system for developing latent electrostatic images carried by an imaging surface of an electrostatographic processor; said development system including a sump for storing a supply of developer having toner and carrier components, said means for circulating said developer along a predetermined path running from said sump, through a development zone, and then back to said sump; the improvement comprising a hybrid crossmixer having parallel active and passive sections positioned in said path, and flow splitting means in said path upstream of said crossmixer for dividing the circulating developer so that part passes through the active section of said crossmixer while another part passes through the passive section, whereby the toner and carrier components of said developer are simultaneously subjected to efficient blending and mixing.

2. The improvement of claim 1 wherein said development system further includes means for supplying said developer with additional toner from time-to-time to maintain a suitably high toner concentration in said developer, and said toner supply means is positioned to add the additional toner via the active section of said crossmixer, whereby the additional toner is rapidly blended in with the balance of the developer.

3. The improvement of claim 1 wherein said crossmixer comprises an auger-type active section and two baffle-type passive sections, and said flow splitting means guides approximately one half of the circulating developer into said active section while dividing the other half substantially equally between the two passive sections.

4. The improvement of claim 3 wherein said development system further includes a housing extending across said development zone, the passive sections of said crossmixer are mounted on opposite sides of said housing and comprise respective sets of downwardly and inwardly inclined baffles for deflecting developer toward a central area of said housing, and the active section of said crossmixer extends across said housing and comprises a rotatable compound auger partially surrounded by a trough for urging developer outwardly toward the opposite sides of said housing.

5. The improvement of claim 4 wherein said flow splitting means comprises a downwardly inclined ramp leading to said crossmixer, said ramp being partitioned widthwise of said development zone to provide separate channels for guiding developer into said passive sections and said active section of said crossmixer.

6. The improvement of claim 5 wherein said development system further includes means for supplying said developer with additional toner as needed to maintain a suitably high toner concentration in said developer, and said toner supplying means is mounted on said housing above said ramp in vertical alignment with a channel leading to the active section of said crossmixer.

7. In a magnetic brush development system having a housing including at least one applicator roll for brushing a developer containing a mixture of triboelectrically charged toner and ferromagnetic carrier particles against an imaging surface of an electrostatographic processor as said imaging surface advances lengthwise of a development zone, and a sump for storing a supply of said developer; the improvement comprising a hybrid crossmixer having at least one active section and at least one passive section mounted in parallel in said housing downstream of said applicator roll and above said sump, and a downwardly inclined ramp supported by said housing for guiding excess developer from said applicator roll to said crossmixer, said ramp being partitioned to route part of said excess developer to the active section of said crossmixer and another part of said excess developer to the passive section.

8. The improvement of claim 7 wherein said crossmixer has an active section comprising a trough extending across said housing, and a compound auger rotatably supported within and partially surrounded by said trough; and a pair of passive sections mounted on opposite sides of said housing; and wherein said ramp is partitioned widthwise of said development zone at regular intervals to guide approximately one half of the excess developer enroute to said crossmixer into the active section and to divide the other half of said excess developer substantially equally between said passive sections.

9. The improvement of claim 8 wherein said auger has a left-hand helix and a right-hand helix extending outwardly from its center toward its opposite ends for urging developer in said trough outwardly toward the opposite sides of said housing, and each of said passive sections has a downwardly and inwardly inclined set of spaced apart baffles for deflecting developer inwardly toward a central area of said housing.

10. The improvement of claim 8 wherein said development system further includes a toner dispenser mounted on said housing in vertical alignment with a portion of said ramp leading to the active section of said crossmixer for adding additional toner to said developer via the active section of the crossmixer.

11. A method of mixing excess developer returning from the development zone in an electrostatographic processor with toner to provide a mixed and blended developer product comprising the steps of:

providing a hybrid crossmixer having an active section and a passive section;

dividing said excess developer into first and second portions;

concurrently passing said first and second portions of said excess developer into said active and passive sections, respectively;

dividing said toner into first and second portions; and concurrently passing said first and second portions of said toner into said active and passive sections, whereby a mixed and blended developer product is obtained.

12. The combination recited in claim 11 further including the step of directing said blended product from each of said active and passive sections into a common collecting chamber.

* * * * *